US007157611B2

(12) United States Patent
Banavali et al.

(10) Patent No.: US 7,157,611 B2
(45) Date of Patent: Jan. 2, 2007

(54) PYRAZINOPORPHYRAZINES AS MARKERS FOR LIQUID HYDROCARBONS

(75) Inventors: Rajiv Manohar Banavali, Rydal, PA (US); Kim Sang Ho, Richboro, PA (US)

(73) Assignee: Rohm and Haas Company, Philadelphia, PA (US)

( * ) Notice: Subject to any disclaimer, the term of this patent is extended or adjusted under 35 U.S.C. 154(b) by 664 days.

(21) Appl. No.: 10/465,211

(22) Filed: Jun. 19, 2003

(65) Prior Publication Data

US 2004/0010169 A1 Jan. 15, 2004

Related U.S. Application Data

(60) Provisional application No. 60/395,120, filed on Jul. 11, 2002.

(51) Int. Cl.
*C01M 139/00* (2006.01)
*C10L 1/28* (2006.01)
*C10L 1/30* (2006.01)

(52) U.S. Cl. ..... 585/4; 585/5; 508/203; 508/204; 508/256; 436/56; 436/139; 44/320; 44/335

(58) Field of Classification Search ..... 508/256; 44/335
See application file for complete search history.

(56) References Cited

U.S. PATENT DOCUMENTS

| | | | | |
|---|---|---|---|---|
| 4,657,554 A | | 4/1987 | Graf et al. | |
| 4,769,163 A | * | 9/1988 | Boes et al. | 508/203 |
| 4,975,210 A | * | 12/1990 | Boes, et al. | 508/203 |
| 5,062,990 A | | 11/1991 | Yamamoto et al. | |
| 5,525,516 A | | 6/1996 | Krutak et al. | 436/56 |
| 5,677,199 A | * | 10/1997 | Arrhenuis | 436/536 |
| 5,804,447 A | | 9/1998 | Albert et al. | 436/56 |
| 6,121,442 A | * | 9/2000 | Faust et al. | 540/145 |
| 6,274,381 B1 | | 8/2001 | Pauls et al. | 436/56 |
| 6,312,958 B1 | | 11/2001 | Meyer et al. | 436/56 |
| 6,340,745 B1 | | 1/2002 | Meyer et al. | 534/702 |

FOREIGN PATENT DOCUMENTS

| | | |
|---|---|---|
| EP | 0201368 A1 | 11/1986 |
| GB | 1 479 502 | 7/1977 |
| JP | 11116573 | 4/1999 |

OTHER PUBLICATIONS

Jurgen Fabian, Hiroyuki Nakazumi and Masaru Matsuoka; Near-Infrared Absorbing Dyes; Chem. Rev.; vol. 92, No. 6; pp. 1197-1226; (1992).

Masaru Matsuoka, NIR Dyes for Information Recording, From Orgin to Update; *Near-Infrared Dyes for High Technology Applications*, 203-231; (1998) Kluwer Academic Publishers.

Patent Abstracts of Japan, vol. 0150, No. 27 (C-0797), Jan. 22, 1991 & JP 2 268102 A (Nippon Soda Co Ltd), Nov. 1, 1990.

Patent Abstracts of Japan, vol. 0150, No. 60 (C-0805), Feb. 13, 1991 & JP 2 289576 A (Nippon Soda Co Ltd), Nov. 29, 1990.

* cited by examiner

*Primary Examiner*—Ellen M. McAvoy
(74) *Attorney, Agent, or Firm*—Kenneth Crimaldi

(57) ABSTRACT

A method for marking a liquid petroleum hydrocarbon. The method comprises adding to the liquid petroleum hydrocarbon a pyrazinoporphyrazine dye having an absorption maximum from 700 nm to 900 nm.

9 Claims, No Drawings

PYRAZINOPORPHYRAZINES AS MARKERS FOR LIQUID HYDROCARBONS

CROSS REFERENCE TO RELATED PATENT APPLICATIONS

This is a non-provisional application of prior pending U.S. provisional application Ser. No. 60/395,120 filed Jul. 11, 2002.

BACKGROUND

This invention relates generally to a method for marking petroleum hydrocarbons with pyrazinoporphyrazine compounds for subsequent identification.

M. Matsuoka, in "NIR Dyes for Information Recording," *Near-Infrared Dyes for High Technology Applications* (S. Daehne et al., eds.), pages 203–231 (Kluwer Academic Publishers, 1998), discloses pyrazinoporphyrazine compounds for use in solid optical information recording systems, e.g., recordable compact disks. This reference, however, does not suggest a method for marking petroleum hydrocarbons.

The problem addressed by this invention is to find a marker suitable for use in petroleum hydrocarbons.

STATEMENT OF INVENTION

The present invention is directed to a method for marking a liquid petroleum hydrocarbon. The method comprises adding to the liquid petroleum hydrocarbon a pyrazinoporphyrazine dye having an absorption maximum from 700 nm to 900 nm.

DETAILED DESCRIPTION

All percentages are weight percentages, unless otherwise indicated. Concentrations in parts per million ("ppm") are calculated on a weight/volume basis. The term "petroleum hydrocarbons" refers to products having a predominantly hydrocarbon composition, although they may contain minor amounts of oxygen, nitrogen, sulfur or phosphorus, that are derived from petroleum refining processes, preferably lubricating oil, hydraulic fluid, brake fluid, gasoline, diesel fuel, kerosene, jet fuel and heating oil. An "alkyl" group is a hydrocarbyl group having from one to twenty carbon atoms in a linear, branched or cyclic arrangement. Alkyl groups optionally have one or more double or triple bonds. Substitution on alkyl groups of one or more halo, hydroxy, alkoxy, alkanoyl or aroyl groups is permitted. Preferably, alkyl groups have no halo or alkoxy substituents. An "alkoxy" group is an alkyl group linked via an oxygen atom, i.e., a hydroxy group substituted by an alkyl group. A "heteroalkyl" group is an alkyl group having at least one carbon which has been replaced by O, NR, or S, wherein R is hydrogen, alkyl, heteroalkyl, aryl or aralkyl. An "aryl" group is a substituent derived from an aromatic hydrocarbon compound. An aryl group has a total of from six to twenty ring atoms, and has one or more rings which are separate or fused. An "aralkyl" group is an "alkyl" group substituted by an "aryl" group. A "heterocyclic" group is a substituent derived from a heterocyclic compound having from five to twenty ring atoms, at least one of which is nitrogen, oxygen or sulfur. Preferably, heterocyclic groups do not contain sulfur. Substitution on aryl or heterocyclic groups of one or more halo, cyano, hydroxy, alkyl, heteroalkyl, alkanoyl, aroyl or alkoxy groups is permitted. Preferably, aryl and heterocyclic groups do not contain halogen atoms. An "aromatic heterocyclic" group is a heterocyclic group derived from an aromatic heterocyclic compound.

An "organic functional group" is a functional group which does not contain metal atoms, and which has from one to twenty-two carbon atoms, hydrogen atoms, and optionally heteroatoms, including but not limited to: nitrogen, oxygen, sulfur, phosphorus, silicon and halogen atoms. An organic functional group optionally contains double and/or triple bonds; rings, which are linked or fused; and if the group is wholly or partly acyclic, the acyclic part can be linear or branched.

A "pyrazinoporphyrazine dye" is a compound containing a porphyrazine ring system, as shown below,

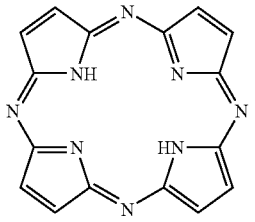

with a pyrazine ring fused through its 2- and 3-positions to the 3- and 4-positions of each pyrrole ring of the porphyrazine ring system, with each pyrazine ring being further substituted by an aryl or aromatic heterocyclic group linked by a single bond or fused to the pyrazine ring.

In a preferred embodiment of the invention, the pyrazinoporphyrazine compound has the structure shown in Formula (I)

(I)

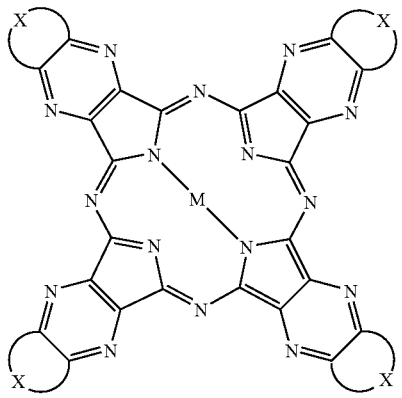

wherein M represents two hydrogen atoms; a transition metal, silicon or aluminum; or any one of: a transition metal, silicon and aluminum, substituted by one or more of oxide, hydroxide, halide or an organic functional group; and X represents an aryl or aromatic heterocyclic group fused to the pyrazine ring. Preferably, M represents two hydrogen atoms; copper, iron, aluminum or silicon; or an oxide, hydroxide, alkanoate or alkoxide of copper, iron, aluminum or silicon. Examples of X substituents include, but are not limited to benzo, pyrrolo, furano, indolo, naphtho or benzofurano In a preferred embodiment of the invention, X in formula (I) represents a benzo or substituted benzo substituent, and the resulting pyrazinoporphyrazine compound (a "benzopyrazinoporphyrazine") has formula (II)

(II)

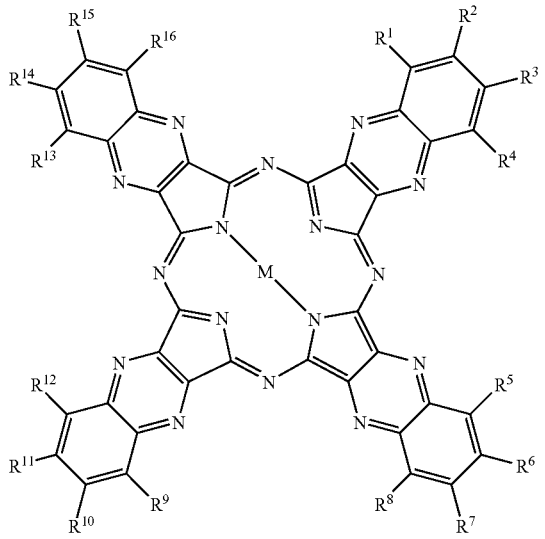

wherein $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$and $R^{16}$independently are hydrogen or an organic functional group, or any pair of R groups on adjacent carbon atoms combines to form an aliphatic, aromatic or heterocyclic ring system fused to the benzo group to which the pair of R groups is attached. Preferably, $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$and $R^{16}$ independently are hydrogen; alkyl; heteroalkyl; aryl; aralkyl; halo; hydroxy or hydroxy substituted by alkyl, heteroalkyl, aryl, aralkyl, heterocyclic, alkanoyl or aroyl groups; cyano; nitro; alkanoyl; aroyl; heterocyclic; amino or amino substituted by alkyl, heteroalkyl, aryl, aralkyl, heterocyclic, alkanoyl or aroyl groups; carboxyl; alkyl, aralkyl, heteroalkyl or heterocyclic ester groups; amide groups, unsubstituted or substituted by alkyl, heteroalkyl, aryl, aralkyl, heterocyclic, alkanoyl or aroyl groups; or any pair of R groups on adjacent carbon atoms combines to form an aliphatic, aromatic or heterocyclic ring system fused to the benzo group to which the pair of R groups is attached.

In one preferred embodiment, $R^1$, $R^4$, $R^5$, $R^8$, $R^9$, $R^{12}$, $R^{13}$ and $R^{16}$ are hydrogen. Preferably, $R^2$, $R^3$, $R^6$, $R^7$, $R^{10}$, $R^{11}$, $R^{14}$ and $R^{15}$ independently are hydrogen, alkyl, aryl or heterocyclic aromatic; more preferably $R^2$, $R^3$, $R^6$, $R^7$, $R^{10}$, $R^{11}$, $R^{14}$ and $R^{15}$ independently are aryl or heterocyclic aromatic. In one preferred embodiment, $R^2$, $R^3$, $R^6$, $R^7$, $R^{10}$, $R^{11}$, $R^{14}$ and $R^{15}$ are aryl and M is copper; preferably $R^2$, $R^3$, $R^6$, $R^7$, $R^{10}$, $R^{11}$, $R^{14}$ and $R^{15}$ are phenyl.

In another preferred embodiment of the invention, X in formula (I) represents an aromatic heterocyclic ring system containing a five-membered heterocyclic ring, and the aromatic heterocyclic ring system is attached by fusing the five-membered heterocyclic ring to each pyrazine ring in formula (I). Preferably, the five-membered heterocyclic ring is a pyrrole or furan ring which can be fused at its 2- and 3-positions, or at its 3- and 4-positions, to a pyrazine ring, as shown below, respectively.

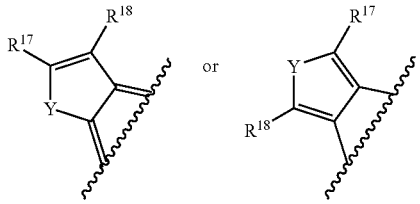

When the five-membered heterocyclic ring is fused at the 2- and 3-positions, the ring optionally is part of a larger polycyclic aromatic heterocyclic ring system, e.g., an indole. When the five-membered heterocyclic ring is fused at the 2- and 3-positions, the resulting pyrazinoporphyrazine compound has several possible isomers, depending on the orientation of the four "Y" groups relative to each other. The most symmetrical isomer is depicted below as formula (III)

(III)

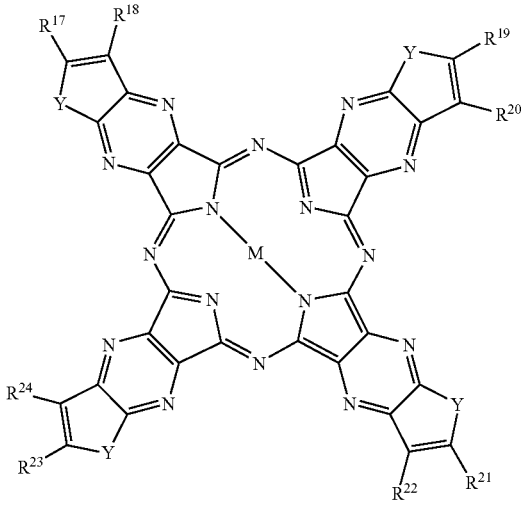

wherein Y is O or $NR^{25}$; $R^{17}$, $R^{18}$, $R^{19}$, $R^{20}$, $R^{21}$, $R^{22}$, $R^{23}$, $R^{24}$ and $R^{25}$ independently are hydrogen or organic functional groups, or any pair of R groups attached to adjacent ring atoms combines to form an aliphatic, aromatic or heterocyclic ring system fused to the pyrrole or furan ring to which the pair of R groups is attached. Preferably, $R^{17}$, $R^{18}$, $R^{19}$, $R^{20}$, $R^{21}$, $R^{22}$, $R^{23}$, $R^{24}$ and $R^{25}$ independently are hydrogen; alkyl; heteroalkyl; aryl; aralkyl; halo; hydroxy or hydroxy substituted by alkyl, heteroalkyl, aryl, aralkyl, heterocyclic, alkanoyl or aroyl groups; cyano; nitro; alkanoyl; aroyl; heterocyclic; amino or amino substituted by alkyl, heteroalkyl, aryl, aralkyl, heterocyclic, alkanoyl or aroyl groups; carboxyl; alkyl, aralkyl, heteroalkyl or heterocyclic ester groups; amide groups, unsubstituted or substituted by alkyl, heteroalkyl, aryl, aralkyl, heterocyclic, alkanoyl or aroyl groups; or any pair of R groups on adjacent carbon atoms combines to form an aliphatic, aromatic or heterocyclic ring system fused to the pyrrole or furan ring to which the pair of R groups is attached.

In one preferred embodiment, in a pyrazinoporphyrazine having furan or pyrrole rings fused at their 2- and 3-positions to the pyrazine rings, $R^{17}$ and $R^{18}$, $R^{19}$ and $R^{20}$, $R^{21}$ and $R^{22}$, and $R^{23}$ and $R^{24}$ combine to form benzo groups fused to the furan or pyrrole rings. The resulting compound has several possible isomers, depending on the orientation of the four "Y" groups relative to each other. The most symmetrical isomer is depicted below as formula (IV)

(IV)

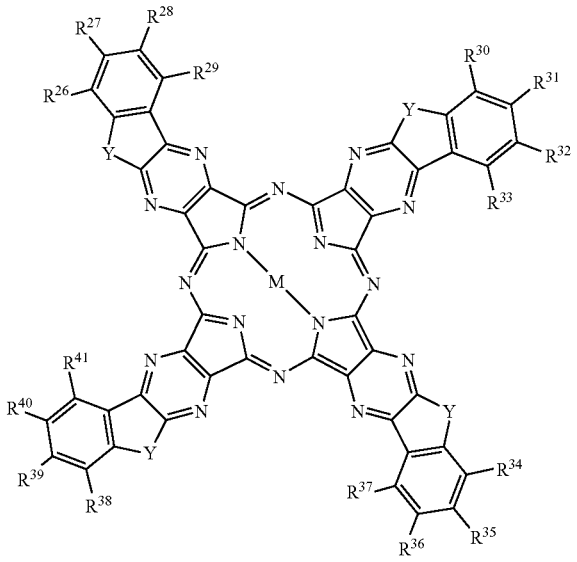

wherein $R^{26}$, $R^{27}$, $R^{28}$, $R^{29}$, $R^{30}$, $R^{31}$, $R^{32}$, $R^{33}$, $R^{34}$, $R^{35}$, $R^{36}$, $R^{37}$, $R^{38}$, $R^{39}$, $R^{40}$and $R^{41}$independently are hydrogen or organic functional groups, or any pair of R groups on adjacent carbon atoms combines to form an aliphatic, aromatic or heterocyclic ring system fused to the benzo ring to which the pair of R groups is attached. Preferably, $R^{26}$, $R^{27}$, $R^{28}$, $R^{29}$, $R^{30}$, $R^{31}$, $R^{32}$, $R^{33}$, $R^{34}$, $R^{35}$, $R^{36}$, $R^{37}$, $R^{38}$, $R^{39}$, $R^{40}$and $R^{41}$ independently are hydrogen; alkyl; heteroalkyl; aryl; aralkyl; halo; hydroxy or hydroxy substituted by alkyl, heteroalkyl, aryl, aralkyl, heterocyclic, alkanoyl or aroyl groups; cyano; nitro; alkanoyl; aroyl; heterocyclic; amino or amino substituted by alkyl, heteroalkyl, aryl, aralkyl, heterocyclic, alkanoyl or aroyl groups; carboxyl; alkyl, aralkyl, heteroalkyl or heterocyclic ester groups; amide groups, unsubstituted or substituted by alkyl, heteroalkyl, aryl, aralkyl, heterocyclic, alkanoyl or aroyl groups; or any pair of R groups on adjacent carbon atoms combines to form an aliphatic, aromatic or heterocyclic ring system fused to the benzo ring to which the pair of R groups is attached.

In one preferred embodiment, Y is $NR^{25}$, and $R^{25}$ is alkyl preferably at least $C_4$ alkyl, most preferably saturated, unsubstituted alkyl. Preferably, at least one of $R^{27}$ and $R^{28}$, at least one of $R^{31}$ and $R^{32}$, at least one of $R^{35}$ and $R^{36}$, and at least one of $R^{39}$ and $R^{40}$ are alkyl, preferably at least $C_4$ alkyl, most preferably saturated, unsubstituted alkyl.

Preferably the amount of each pyrazinoporphyrazine dye which is added to the petroleum hydrocarbon is at least 0.01 ppm, more preferably at least 0.02 ppm, and most preferably at least 0.03 ppm. Preferably the amount of each pyrazinoporphyrazine dye is less than 10 ppm, more preferably less than 2 ppm, and most preferably less than 1 ppm. Preferably, the marking is invisible, i.e., the dye cannot be detected by simple visual observation of the marked hydrocarbon. Preferably, a pyrazinoporphyrazine dye having an absorption maximum in the range from 700 nm to 900 nm used in the method of this invention has an absorption maximum at a wavelength of at least 710 nm, more preferably at least 720 nm, and most preferably at least 750 nm; preferably, the absorption maximum is no greater than 880 nm, more preferably no greater than 860 nm. In one embodiment, at least two pyrazinoporphyrazine dyes having absorption maxima at differential wavelengths are added to the petroleum hydrocarbon. In another embodiment, at least one pyrazinoporphyrazine dye and at least one other dye having an absorption maximum in the range from 700 nm to 900 nm, preferably from 720 nm to 900 nm, are added to the petroleum hydrocarbon. Preferably, each of the other dyes absorbing in this range is present in an amount of at least 0.01 ppm, more preferably at least 0.02 ppm, and most preferably at least 0.03 ppm. Preferably the amount of each other dye is less than 10 ppm, more preferably less than 2 ppm, and most preferably less than 1 ppm.

Preferably, a dye used in the method of this invention is detected by exposing the marked petroleum hydrocarbon to electromagnetic radiation having wavelengths in the portion of the spectrum containing the absorption maxima of the dye and detecting the absorption of light or fluorescent emissions. It is preferred that the detection equipment is capable of calculating dye concentrations and concentration ratios in a marked petroleum hydrocarbon. Typical spectrophotometers known in the art are capable of detecting the pyrazinoporphyrazine dyes used in the method of this invention when they are present at a level of at least 0.01 ppm. It is preferred to use the detectors described in U.S. Pat. No. 5,225,679, especially the SpecTrace™ analyzer available from Rohm and Haas Company, Philadelphia, Pa. These analyzers use a filter selected based on the absorption spectrum of the dye, and use chemometric analysis of the signal by multiple linear regression methods to reduce the signal-to-noise ratio.

When the detection method does not involve performing any chemical manipulation of the marked petroleum hydrocarbon, the sample may be returned to its source after testing, eliminating the need for handling and disposal of hazardous chemicals. This is the case, for example, when the dyes are detected simply by measuring light absorption by a sample of the marked petroleum hydrocarbon.

In one embodiment of the invention, the dye is formulated in a solvent to facilitate its addition to the liquid petroleum hydrocarbon. The preferred solvents for pyrazinoporphyrazine dyes are aromatic hydrocarbon solvents. Preferably, the dye is present in the solvent at a concentration of from 0.1% to 10%.

In one embodiment of the invention, at least one pyrazinoporphyrazine dye, and optionally another dye having an absorption maximum from 700 nm to 900 nm, is added to a petroleum hydrocarbon with at least one visible dye; i.e., a dye having an absorption maximum in the range from 500 nm to 700 nm, preferably from 550 nm to 700 nm, and most preferably from 550 nm to 680 nm. Preferably, each visible dye is added in an amount of at least 1 ppm, preferably at least 2 ppm, and most preferably at least 5 ppm. Preferably, the amount of each visible dye is no more than 20 ppm, more preferably no more than 15 ppm. In a preferred embodiment, the visible dyes are selected from the classes of anthraquinone dyes and azo dyes. Suitable anthraquinone dyes having an absorption maximum in this region include, for example, 1,4-disubstituted anthraquinones having alkylamino, arylamino or aromatic-heterocyclic-amino substituents. Suitable azo dyes having an absorption maximum in this region include, for example, those having the structure Ar—N═N—Ar—N═N—Ar, in which Ar is an aryl group, and each Ar may be different. Specific examples of suitable commercial anthraquinone and azo dyes having an absorption maximum in this region are listed in the Colour Index, including C.I. Solvent Blue 98, C.I. Solvent Blue 79, C.I. Solvent Blue 99 and C.I. Solvent Blue 100.

Incorporation of at least one pyrazinoporphyrazine dye having an absorption maximum in the region from 700 nm to 900 nm allows identification of the liquid hydrocarbon by spectrophotometric means in a spectral region relatively free of interference. Low levels of these dyes are detectable in this region, allowing for a cost-effective marking process, and availability of multiple dyes allows coding of information via the amounts and ratios of the dyes. For these reasons, additional compounds absorbing in this range, and suitable as fuel markers, are extremely useful.

Combinations of markers detectable at 700 nm to 900 nm with markers detectable in the visible range also are useful. Incorporation of higher levels of at least one visible dye having an absorption maximum in the region from 500 nm to 700 nm facilitates quantitative spectrophotometric determination in this region. Accurate determination of the dye levels allows the amounts and ratios of the dyes to serve as parts of a code identifying the hydrocarbon. Since dyes absorbing in this region often are less costly, use of a higher level will not greatly increase the overall cost of the marking process. Thus, the combination of the two kinds of dyes increases the flexibility and minimizes the cost of the marking process.

Methods of preparation of the compounds of this invention are known to those skilled in the art. For example, JP11-116573 (Matsuoka, et al., publication date: Apr. 27, 1999), discloses synthetic routes to many compounds of this type.

What is claimed is:

1. A method for marking a liquid petroleum hydrocarbon; said method comprising adding to said liquid petroleum hydrocarbon from 0.01 ppm to 10 ppm of at least one pyrazinoporphyrazine dye having an absorption maximum from 700 am to 900 nm.

2. The method of claim 1 in which said at least one pyrazinoporphyrazine dye has formula (I)

(I)

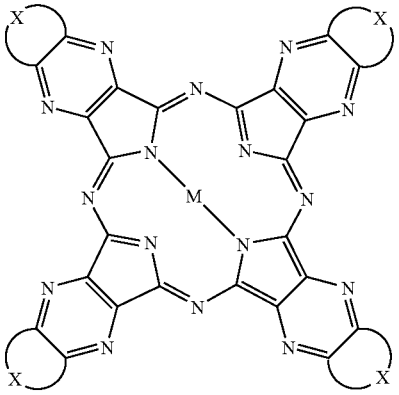

wherein M represents two hydrogen atoms; a transition metal, silicon or aluminum; or any one of a transition metal, silicon and aluminum, substituted by one or more of oxide, hydroxide, halide or an organic functional group; and X represents a cyclic aromatic system fused to the pyrazine ring.

3. The method of claim 2 in which said at least one pyrazinoporphyrazine dye has formula (II)

(II)

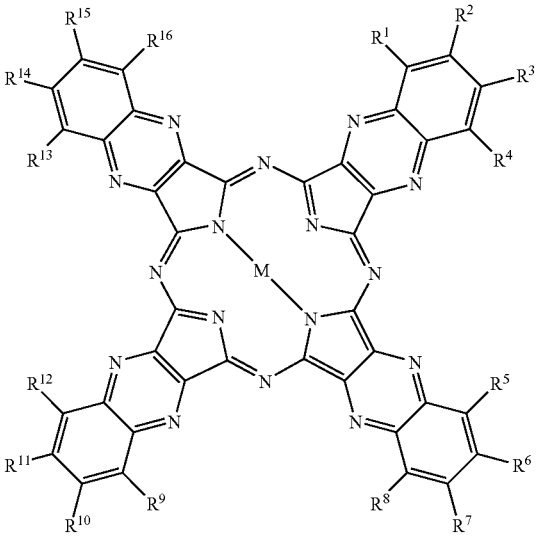

wherein $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$ and $R^{16}$ independently are hydrogen or an organic functional group, or any pair of R groups on adjacent carbon atoms combines to form an aliphatic, aromatic or heterocyclic ring system fused to a benzo group to which the pair of R groups is attached.

4. The method of claim 2 in which X represents an aromatic heterocyclic ring system containing a five-membered heterocyclic ring, and the aromatic heterocyclic ring system is attached by fusing the five-membered heterocyclic ring to a pyrazine ring in formula (I).

5. The method of claim 4 in which said at least one pyrazinoporphyrazine dye has formula (III) or an isomer thereof having a different orientation of Y groups (III)

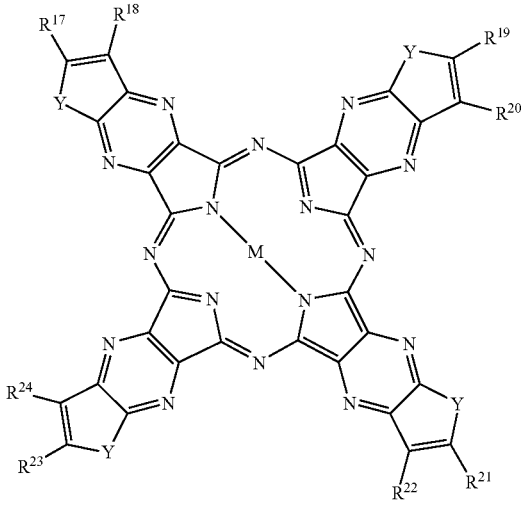

wherein Y is O or $NR^{25}$; $R^{17}$, $R^{18}$, $R^{19}$, $R^{20}$, $R^{21}$, $R^{22}$, $R^{23}$, $R^{24}$ and $R^{25}$ independently are hydrogen or organic functional groups, or any pair of R groups attached to adjacent ring atoms combines to form an aliphatic, aromatic or heterocyclic ring system fused to a pyrrole or furan ring to which the pair of R groups is attached.

6. The method of claim 5 in which said at least one pyrazinoporphyrazine dye has formula (IV) or an isomer thereof having a different orientation of Y groups (IV)

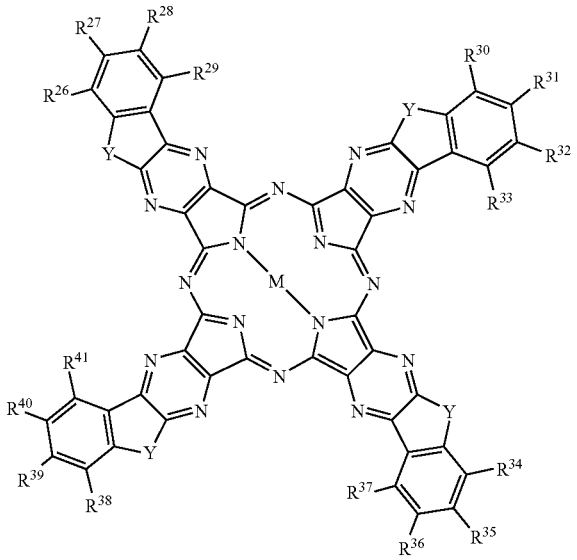

wherein $R^{26}$, $R^{27}$, $R^{28}$, $R^{29}$, $R^{30}$, $R^{31}$, $R^{32}$, $R^{33}$, $R^{34}$, $R^{35}$, $R^{36}$, $R^{37}$, $R^{38}$, $R^{39}$, $R^{40}$ and $R^{41}$ independently are hydrogen or organic functional groups, or any pair of R groups on adjacent carbon atoms combines to form an aliphatic, aromatic or heterocyclic ring system fused to a benzo ring to which the pair of R groups is attached.

7. The method of claim 1 in which the liquid petroleum hydrocarbon is selected from the group consisting of lubricating oil, hydraulic fluid, brake fluid, gasoline, diesel fuel, kerosene, jet fuel and heating oil.

8. The method of claim 7 further comprising at least one visible dye in an amount from 1 ppm to 20 ppm.

9. The method of claim 8 in which each porphyrazine dye is present in an amount from 0.01 ppm to 2 ppm, and each visible dye is present in an amount from 2 ppm to 20 ppm.

* * * * *